US006919041B2

(12) United States Patent
Dvilis et al.

(10) Patent No.: US 6,919,041 B2
(45) Date of Patent: Jul. 19, 2005

(54) METHOD FOR COMPACTING POWDER MATERIALS INTO ARTICLES AND A MOLD FOR IMPLEMENTING THE METHOD

(75) Inventors: Edgar Sergeevich Dvilis, Tomsk (RU); Oleg Leonidovich Khasanov, Tomsk (RU); Vitaly Mikhailovich Sokolov, Tomsk (RU); Jury Petrovich Pokholkov, Tomsk (RU)

(73) Assignee: Tomsky Polytekhnichesky Universitet, Tomsk (RU)

( * ) Notice: Subject to any disclaimer, the term of this patent is extended or adjusted under 35 U.S.C. 154(b) by 196 days.

(21) Appl. No.: 10/319,538

(22) Filed: Dec. 16, 2002

(65) Prior Publication Data

US 2003/0124018 A1 Jul. 3, 2003

(30) Foreign Application Priority Data

Dec. 14, 2001 (RU) ..... 2001134178

(51) Int. Cl.[7] ..... B22F 3/02
(52) U.S. Cl. ..... 419/38; 425/78
(58) Field of Search ..... 419/38; 425/78; 418/38

(56) References Cited

U.S. PATENT DOCUMENTS 2,791,804 A * 5/1957 Talmage ..... 419/38
3,140,327 A * 7/1964 Dettmer ..... 264/119
4,906,434 A * 3/1990 Ashbee ..... 419/51

OTHER PUBLICATIONS

M. B. Shtern et al., "Phenomenological Theories of Powder Compacting", Kiev, Naukova dumka, 1982, pp. 56–65.

L. I. Klyachko et al., "Equipment and Accessories for Forming Powder Materials", Moscow, Metallurgy, 1986, pp. 202–203.

R. Y. Popilsky et al., "Compacting of Ceramic Powder Masses", Moscow, Metallurgy, 1983, pp. 76–87.

I. M. Fedorchenko et al., "Powder Metallurgy. Materials, Processing, Properties, Fields of Application", Kiev, Naukova dumka, 1985, pp. 160–161, 182–185.

"Ultrasound", *Small Encyclopedia,* edited by Golyamina I.P., Moscow, Sovetskaya Entziklopedia, 1979, p. 346.

B. A. Agranat et al., "Ultrasound in Powder Metallurgy", Moscow, Metallurgy, 1986, pp. 131–133.

A. I. Gusev, "Nanocrystal Materials: Production Methods and Properties", Ekaterinburg: UrO RAN, 1998, P. 57.

* cited by examiner

*Primary Examiner*—Daniel Jenkins
(74) *Attorney, Agent, or Firm*—Burns, Doane, Swecker & Mathis, L.L.P.

(57) ABSTRACT

A method for compacting powder materials into articles comprises placing a powder material in a shaping cavity of a mold, the cavity being defined by active and passive shaping surfaces of one-piece or composite shaping members of the mold; mutually moving the shaping members of the mold along a pressing axis, with the pressing force transferred from the shaping members of the mold to the powder material through the active shaping surfaces. Surfaces of the powder article, parallel to the pressing axis, are formed by the passive shaping surfaces of the one-piece or composite shaping members of the mold. According to the invention, surfaces of the powder article, parallel to the pressing axis, are formed using parts of at least one passive shaping surface, located on the one-piece or composite shaping members split along the pressing axis. The shaping members of the mold are moved so that at least one continuous surface of the powder article, parallel to the pressing axis, is formed by the parts of at least one passive shaping surface split along the pressing axis, the parts belonging to different shaping members moving in opposite directions. A mold is also disclosed for implementing the method.

23 Claims, 13 Drawing Sheets

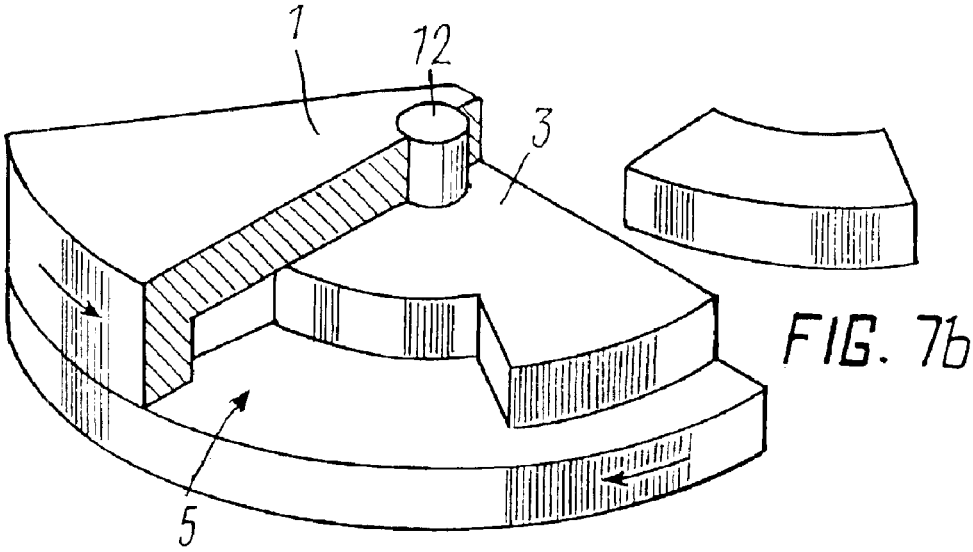
FIG. 7b
FIG. 7a
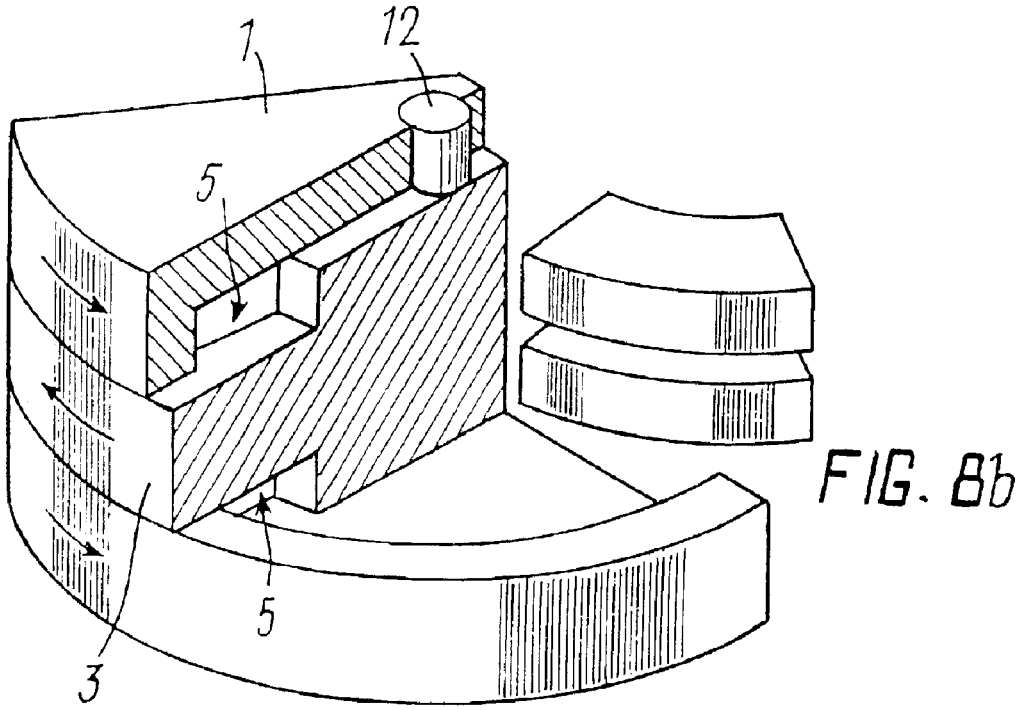
FIG. 8b
FIG. 8a

METHOD FOR COMPACTING POWDER MATERIALS INTO ARTICLES AND A MOLD FOR IMPLEMENTING THE METHOD

FIELD OF THE INVENTION

The present invention relates to power metallurgy and more particularly to a method for compacting powder materials into articles and a mold for implementing the method, and can find application in various branches of industry.

BACKGROUND OF THE INVENTION

A method is known for uniaxial single-action compacting of powder materials in closed molds comprising a matrix with a passive shaping surface that does not transfer the pressing force to the powder being compacted, and punches with shaping surfaces that are capable of transferring the pressing force to the powder being compacted (see e.g. Fedorchenko I. M., Frantzevich I. N., Radomyslensky I. D. et al., Powder Metallurgy. Materials, Processing, Properties, Fields of Application, Kiev, Naukova dumka, 1985). The compacting is accomplished by transferring the pressing force to the powder through the active shaping surface of one of the punches. The prior method permits fabrication of articles of Complexity Groups I and II having a shape factor value close to unity.

When articles of complexity group III are manufactured by this method, in order to reduce the value of compacting density differential along the article height by one half as compared to a single-action compacting scheme, a double-action uniaxial compacting is implemented. To provide the same conditions for articles of Complexity Groups IV–VII having different changes in height, the use is made of composite punches with independently moving components, and specialized multi-pass presses with synchronized and controlled travel of their components.

The basic problem with the prior art method is that in all compacting routes the average density distribution of the powder article through its cross-section normal to the pressing axis, along the article height and throughout the volume has an explicitly nonuniform character with the layers of the same density being bent in the direction of the pressing punch movement (Shtern M. B., Serdyuk G. G., Maximenko L. A., Trukhan Y. V., Shulyakov Y. M. Phenomenological Theories of Powder Compacting, Kiev, Naukova dumka, 1982).

In the conditions of large-scale production of powder articles of Complexity Groups I, II, III, multi-form molds are used, this many times enhancing labor intensity as the number of shaping components (punches and cavities of the multi-form matrix) corresponds to the number of articles compacted at once. When compacting articles of irregular shape with a developed surface, split dies are used in order to eliminate destructive impact of elastic aftereffect (Klyachko L. I., Umansky A. M., Bobrov V. N. Equipment and Accessories for Forming Powder Materials, Moscow, Metallurgy, 1986), this increases the number of die components and complicates the process of die fabrication and operation, but the problems of obtaining an acceptable uniform density of pressed articles along the height still remain.

Most closely related to the present invention is a method for compacting sleeves with counter movement of a matrix and an insertion rod, comprising the steps of: placing a powder material in a shaping cavity of a mold, the shaping cavity being defined by active and passive shaping surfaces of one-piece or composite shaping members of the mold; mutually moving the shaping members of the mold along the pressing axis, with the pressing force transferred from the shaping members of the mold to the powder material through the active shaping surfaces; and forming surfaces of the powder article, parallel to the pressing axis, by passive shaping surfaces of the one-piece or composite shaping members (see e.g. Popilsky R. Y., Pivinsky Y. E. Compacting Powder Ceramic Masses, Moscow, Metallurgy, 1983).

In the prior method, the passive shaping surfaces, located on the matrix and the insertion rod, form the external and internal side surfaces of the article, while the active shaping surfaces, located on the punches, form end faces of the article. Being rigidly connected, the matrix and one pressing punch and the rod and the other pressing punch accomplish mutual counter movement, and the pressing force is transferred through the active shaping surfaces. Such an arrangement permits fabrication of sleeve-shaped articles with more uniform density distribution along the height of the article.

Under the same friction conditions on both of the passive shaping surfaces defining the internal and external side surfaces of the article when it is compacted with counter movement of the matrix and the insertion rod, the average density differential in the section normal to the pressing axis along the height cannot be zero as it is determined by the difference in the areas of the opposite side surfaces, external and internal.

Differentials of the average axial pressure, $\Delta P$, in the cross section and the average powder body density, $\Delta\rho$, along its height, when a sleeve is compacted with counter movement of the matrix and the rod, depend on factors of wall friction f and lateral pressure $\xi$, height h of the article and values of external radius $r_1$ and internal radius $r_2$ of the sleeve being compacted:

$$\Delta P = 2 \cdot f \cdot P_b \frac{h}{r_2 + r_1} \tag{1}$$

$$\Delta P = 2 \cdot f \cdot \xi \frac{h}{r_2 + r_1} \tag{2}$$

where $P_b$ is the average lateral pressure along the height of the article.

The method of compacting sleeves with counter movement of the matrix and the insertion rod has a significant drawback. When forming a sleeve-shaped article, it is impossible to provide uniform distribution of density along the height of the article as areas of its side surfaces (internal and external) cannot be equal. In compacting hard-to-form powders this causes stratification of long-length articles, leads to nonuniform shrinkage and inadmissible changes in the shape in further sintering.

It should be noted that the constraints currently placed on purity of materials in powder technology, the quest for reduction in costs and simpler preparation operations prohibit the use of lubricants in manufacture of critical parts. Furthermore, reduction of wall friction parameters by process lubricants will prevent meeting the uniform density requirement. The difference in the area relation of the counter moving parts of the passive shaping surface will lead to the necessity to choose a lubricant composition reducing the wall friction factor in proportion to this relation.

A mold is known for uniaxial compacting of powder articles in a sealed volume, that comprises three shaping members: a matrix and two: punches. The punches directly receive the pressing force by a section following the shape of end faces of the article which is formed by active shaping surfaces of the punches, while the matrix defines a side surface of the article, parallel to the pressing axis, and receives lateral pressure force from the compacted powder by its passive shaping surface (Fedorchenko I. M., Frantzevich I. N., Radomyslensky I. D. et al., Powder Metallurgy. Materials, Processing, Properties, Fields of Application, Kiev, Naukova dumka, 1985).

The section of the shaping member of the mold, that receives the pressing force, depends on the hydraulic area of the powder article. This makes requirements to the mold material quality more stringent, reduces service life of the mold and substantially restricts the permissible range of compaction pressures, especially for the articles having a small section in the direction of the pressing axis.

The presence of closed passive shaping surfaces on the mold members, that are hard to reach directly and the quality of which must meet stringent requirements, makes their processing in the manufacturing process and maintenance in operation of the mold more difficult.

When long-length articles of plastic powders that are prone to entrapping air, or powders with a high content of liquid or process lubricant are fabricated in the prior art mold, their removal from the closed volume of the matrix cavity in the compacting process is problematic.

Most closely related to an apparatus for implementing a method in accordance with the present invention is a mold for compacting sleeve-shaped powder articles, comprising a pair of one-piece or composite shaping members that form a shaping cavity defined by active and passive shaping surfaces, the shaping members being arranged so as to mutually move along a pressing axis, with the compaction pressure transferred from the shaping members to the powder material through the active shaping surfaces, while the passive shaping surfaces serve to form surfaces of the powder article that are parallel to the pressing axis (see e.g. Fedorchenko I. M., Frantzevich I. N., Radomyslensky I. D. et al., Powder Metallurgy. Materials, Processing, Properties, Fields of Application, Kiev, Naukova dumka, 1985).

In case of monolith combination of one punch and the insertion rod in one shaping member, and the other punch and the matrix in the other shaping member, the mold allows the permissible range of compaction pressures to be somewhat extended.

However, rigid connection of the matrix and one of the punches substantially hampers or even prevents removal of the compacted article. Furthermore, the apparatus exhibits a structural restraint to increasing the punch section receiving the pressing force due to its combination with the insertion rod. Actual gain in extension of the compaction pressure range is therefore insignificant.

Analytic reasoning of a compacting method in accordance with the invention and derivation of expression for density differential along the height of a powder article produced by the method.

Referring to the drawings, FIGS. 1*a, b, c* shows molds for uniaxial single-action compacting powder materials into a cylinder article. FIGS. 2*a, b, c* shows respective schematic diagrams of compacting the powder article. Solid lines show places of mobile mating of parts of a common shaping surface in the compacting process.

FIG. 1*a* shows a prior art mold for implementing a prior art method of uniaxial single-action compacting of a powder material into a cylinder article, FIGS. 1*b, c*—molds according to the invention. the mold comprising a first shaping member 1 with an active shaping surface 2, and a second shaping member 3 with a passive shaping surface 4, which define a shaping cavity 5. FIG. 2*a* shows a schematic diagram of compacting a powder material into a cylinder body.

At the powder body segment adjacent to line 6 (FIG. 1*a*) of a mobile mating of the active shaping surface 2 of the shaping member 1 and the passive shaping surface 4, i.e. around circumference A', B', C' and D' (FIG. 2*a*), the values of powder movement relative to the passive shaping surface, wall friction force and compaction ratio are maximum. At places of fixed mating, i.e. around circumference A, B, C and D, the movement and wall friction force are close to zero and, respectively, the powder compacting ratio is minimum (see e.g. Shtern M. B. et al. Phenomenological Theories of Compacting Powders, Kiev, Naukova dumka, 1982, page 140).

At half the distance between the mobile and fixed active shaping surfaces, i.e. around circumference a, b, c, d, the above values are average. The average density value in section a, b, c, d is the average density throughout the volume of the compacted article. Density distribution in the compacted body along its height is a function of the article height-to-diameter relation and may be uniform only if the compacting ratio is 100%.

From the theory of compacting powder materials in closed molds (see e.g. Popilsky P. Y. et al. Compacting Powder Ceramic Masses, Moscow, Metallurgy, 1983) it is known that due to the wall friction the density differential $\Delta\rho$ along the height of the compacted article in its central part (FIGS. 2*a, b*) along axis EeE' will be always smaller than that near walls (along line AaA'), while the average density value $\langle\rho\rangle$ along any vertical will be the same at any instant of compacting:

$$\Delta\rho_{[AaA']} \geqq \Delta\rho_{[EeE']} \quad (3)$$

$$\langle\rho\rangle_{[AaA']} = \langle\rho\rangle_{[EeE']} = \langle\rho\rangle_{[CcC']} \quad (4)$$

FIG. 1*a* shows a known mold for compacting powder materials into articles. In a schematic diagram of compacting a cylindrical powder article by a method in accordance with invention (FIG. 2*b*) in the powder body region adjacent to the line of mobile mating of counter moving parts of the passive shaping surface A'A and C'C, to the left of the line in the region of points A and C, vertical displacement of the powder relative to the passive shaping surface and wall friction forces are close to zero, while to the right of these points the above values are maximum.

In the vicinity of points A' and C' the picture is opposite: to the left of the points the above values are maximum, while to the right they are minimum. Therefore, at any points of the powder article being compacted, adjacent to lines A'A and C'C, values of displacement, wall friction forces with account of sign, and the compaction ratio will be equal to the average values between respective values on different sides of the lines of conjugation.

Consequently, the powder compaction ratio in the region along the line of conjugation of parts of the passive shaping surface A'A and C'CX will be the same. According to relations (3) and (4) at any point of the powder article section plane (hatched region A'ACC') passing through conjugation lines, symmetrical to the central pressing axis, of parts of the passive shaping surface A'A and C'C, the compaction ratio and, hence, the article density will be the same and equal to the average value throughout the article volume.

In the section planes equidistant from the conjugation regions of parts of the passive shaping surface—plane BB'D'D (FIG. 2*b*), the density distribution must follow classic representations with inversion of the parameters in the region of axis of symmetry E'E of the compacted article, along which the density is constant.

Therefore, at points B' and D the powder will undergo intense compaction, while at points B and D' the compaction ratio will be minimum.

Consider the relationship of forces acting in an elementary layer (FIG. 3) with height dh of a powder article compacted by a method in accordance with the invention, wherein the opposite side surfaces of the layer are formed by counter moving parts of a continuous, split along the pressing axis, passive shaping surface of a mold. Assume that values of hydraulic area $S_0$ of the compacted article and total hydraulic perimeter G (which is equal to the sum of perimeters G' and G" of counter moving parts), wall friction factors f' and f" and lateral pressure ξ are constant along the height; the moment of pair of forces $F'_{fr}$ and $F''_{fr}$ can be neglected; the pressure variation caused by powder mass transfer in the direction normal to the pressing axis is absent.

The force acting on the upper base of the layer having thickness dh is:

$$F_0=P\cdot S_0 \tag{5}$$

The force reaction acting on the lower base of the layer is:

$$F_h=(P-dP)\cdot S_0 \tag{6}$$

where dP is the loss of compaction pressure along height dh.

The wall friction force developed at the part of the passive shaping surface that moves in concert with upper active shaping surface is determined by the expression:

$$F'_{fr}=F_{lat}f'=P\cdot\xi\cdot S''\cdot f'=P\cdot\xi\cdot f'\cdot G'\cdot dh \tag{7}$$

where:

$F_{lat}$ is the lateral stress force;

S' is the area of the respective part of the passive shaping surface;

G' is the part of the total hydraulic perimeter, relating to the part of the passive shaping surface having area S';

f' is the factor of the wall friction acting on surface S'.

The wall friction force developed on the part of the passive shaping surface that moves in concert with the lower active shaping surface is:

$$F''_{fr}=F_{lat}f''=P\cdot\xi\cdot S''\cdot f''=P\cdot\xi\cdot f''\cdot G''\cdot dh \tag{8}$$

In the state of static balance of forces $$F_0=F_h+{}''_{fr}-F''_{fr},$$

$$P\cdot S_0=(P-dP)\cdot S_0+P\cdot\xi\cdot f'\cdot G'\cdot dh-P\cdot\xi\cdot f''\cdot G''\cdot dh \tag{9}$$

By integrating, obtain $$\ln\left(\frac{P_h}{P_0}\right)=-(G'\cdot f'=G''\cdot f'')\cdot\xi\cdot\frac{h}{S_0} \tag{10}$$

The value of density differential along the article height is:

$$\Delta\rho=b\cdot(G'\cdot f'-G''\cdot f'')\cdot\xi\cdot\frac{h}{S_0} \tag{11}$$

By changing the perimeters to the areas of oppositely directed parts of the passive shaping surface, obtain $$\Delta\rho=b\cdot\xi\cdot\frac{(S'\cdot f'-S''\cdot f'')}{S_0} \tag{12}$$

Validity of the assumptions made in deriving the equation of density distribution along the article height is determined by the following.

Majority of articles produced by compacting in closed molds have a regular geometric shape without changes in lateral sizes along the pressing axis. In compacting articles having a varying height it is necessary to choose a compacting direction that would satisfy the above requirements to the most extent.

In implementing the method for compacting articles of powder materials in closed rigid molds, the wall friction and lateral pressure factors vary along the article height (see e.g. Popilsky P. Y., Pivinsky Y. E. Compacting Powder Ceramic Masses, Moscow, Metallurgy, 1983). However, numerous experimental data have shown that the product of theses values is constant for the same material being compacted under the same conditions at any compaction pressure.

Furthermore, in the present method variations of these values along the pressing axis are cancelled out since they vary in the same way, but in opposite direction. The moment of a pair of oppositely directed wall friction forces during compacting a powder material leads to bending the layers of the same density in the volume of the article compacted. But since the bend value in the regions adjacent to the parts of the passive shaping surface that move in opposite directions will be the same, with different bend direction in the layers, uniform distribution of the cross-sectional average density value is maintained along the pressing axis during the entire compacting process in the method in accordance with the invention. In addition, the presence of the moment of a pair of oppositely directed forces results in increased plastic deformation ratio of the powder material with the dominating shear component, this promoting the formation of a fine-grain (nanocrystal) structure in fabrication of structural and functional articles, and providing the attainment of the object set.

At the segments adjacent to the conjugation line of the counter moving parts of the passive shaping surface, the powder will be transferred in direction normal to the pressing axis due to the presence of the density gradient on both sides of this line. The powder mass transfer in the volume of the compacted article will lead to a change in the character of distribution of the powder body density. However, if there is a large number of parts of the passive shaping surface that move in different directions relative to the article compacted (FIGS. 1*b*, 2*c*), the regions with increased and reduced density will be located side-by-side and change from one region to another through the vertical section regions having the average density (hatched regions).

The closer will be the regions with different compacting character (the more frequently they alternate), the easier the mass transfer occurs between the regions, and the more intense is the shear component of the powder material deformation. In addition, redistribution of the compacted material will occur during the entire compacting process, this equalizing the density throughout the volume since the effective character of its distribution will manifest itself in the compacted article from the instant of minimum load application when the powder is in the bulk density state and its redistribution is not yet restricted by strong bonds, and friction forces between the particles are minimum.

As in any section plane of the powder body normal to the compacting direction according to the present method the reduced and increased density regions alternate with the regions having the average density throughout the article volume, the average density in the sections is the same at any height of the article. Appearance, along the lines of conjugation of parts of the common passive shaping surface split along the pressing axis, of wall friction forces having opposite direction but the same total value leads to equalizing the density throughout the article volume.

In the present method, the density distribution in a powder article is equalized throughout the volume by oppositely directed wall friction forces.

SUMMARY OF THE INVENTION

An object of the present invention is to provide a method for compacting powder materials into articles, in which the powder material density is more evenly distributed throughout the article volume, and which allowing easier removal of liquid and/or process lubricant and entrapped air from the volume of the compacted articles, extend permissible range of compaction pressures, wider assortment and improved quality of powder articles of all complexity groups, elimination of destructive impact of forces of wall friction against surfaces of the closed cavity of the shaping member when the article is removed therefrom, reduced costs of production, operation and service of the molds, less stringent requirements to strength and elastic characteristics of the mold material.

A further object of the present invention is to provide a mold for compacting powder materials into articles, the design of which offers a more uniform distribution of powder density throughout the article volume, this, in turn, allowing easier removal of liquid and/or process lubricant and entrapped air from the volume of the compacted articles, extended permissible range of compaction pressures, wider assortment and improved quality of powder articles of all complexity groups, elimination of destructive impact of forces of wall friction against surfaces of the closed cavity of the shaping member when the article is removed therefrom, reduced costs of production, operation and service of the molds, less stringent requirements to strength and elastic characteristics of the mold material.

The objects are accomplished by a method for compacting powder materials into articles, comprising the steps of: placing a powder material in a shaping cavity of a mold, the cavity being defined by active and passive shaping surfaces of one-piece or composite shaping members of the mold; mutually moving the shaping members of the mold along a pressing axis, with the pressing force transferred from the shaping members of the mold to the powder material through the active shaping surfaces; and forming surfaces of the powder article, parallel to the pressing axis, by the passive shaping surfaces of the one-piece or composite shaping members of the mold, wherein in accordance with the invention:

the forming of surfaces of the powder article, parallel to the pressing axis, comprises using parts of at least one passive shaping surface, located on the one-piece or composite shaping members and split along the pressing axis;

the shaping members of the mold are moved so that at least one continuous surface of the powder article, parallel to the pressing axis, is formed by said parts of at least one passive shaping surface split along the pressing axis, the parts belonging to different shaping members moving in opposite directions.

The compacting is preferably accomplished by counter movement of the one-piece or composite shaping members along a straight pressing axis.

The compacting is preferably accomplished by counter movement of the one-piece or composite shaping members along a curved pressing axis.

The curved pressing axis is advantageously a circular arc or an element of a helical curve with a permanent or variable pitch.

In the compacting of powder materials into articles, mechanical oscillations are preferably applied to the one-piece or composite shaping members of the mold, said mechanical oscillations being of ultrasonic frequency range.

The mechanical oscillations are preferably applied to the one-piece or composite shaping members of the mold, comprising a larger portion of the passive shaping surface.

For compacting articles having an inner cavity or a developed surface it is preferable to use shaping members having a minimum difference between areas of the passive shaping members belonging to oppositely directed shaping members of the mold.

The object of the present invention is also accomplished by a mold for compacting powder materials into articles, comprising a pair of one-piece or composite shaping members for forming a shaping cavity defined by active and passive shaping surfaces, the shaping members being arranged so that to mutually move along a pressing axis, with the pressing force transferred from the shaping members to the powder material through the active shaping surfaces, while the passive shaping surfaces serve to form surfaces of the powder article, parallel to the pressing axis, wherein in accordance with the invention the one-piece or composite shaping members of the mold, split along the pressing axis, comprise a part of at least one continuous passive shaping surface split along the pressing axis;

on each of the shaping members located is at least one part of the at least one continuous passive shaping surface split along the pressing axis and intended for forming surfaces of the powder article, parallel to the pressing axis, and a part of at least one active shaping surface intended for transferring the pressing force.

It is advantageous that each of the one-piece or composite shaping members of the mold comprises parts of the passive shaping surfaces and parts of the active shaping surfaces to define a plurality of cavities for compacting a plurality of powder articles.

The plurality of powder articles are preferably of the same or different shape.

It is preferable that an end face of at least one of the one-piece or composite shaping members has at least one groove for filling the powder material into at least one shaping cavity of the mold.

The shaping members are preferably capable of mutually moving in opposite directions along the pressing axis.

The pressing axis is preferably selected from the group consisting of a straight pressing axis, a curved pressing axis and a circular arc and an element of a helical curve with a permanent or variable pitch.

Advantageously, the mold further comprises means for preventing an off-axis displacement of the one-piece or composite shaping members, said means being a structural element selected from the group consisting of a shroud, a fixture, a pivot of the common axis of mutual movement of the shaping members, a spline engagement of the one-piece or composite members with one another, a bayonet engagement of the one-piece or composite shaping members, an elastic enclosure.

The means for preventing an off-axis displacement of the one-piece or composite shaping members is advantageously at least one of the one-piece or composite shaping members.

The one-piece or composite shaping members advantageously have at least one groove to form a supplemental cavity for collecting gas or liquid forced out when the powder material is compacted.

The supplemental cavity is preferably capable of increasing its volume at mutual movement of the one-piece or composite shaping members of the mold.

It is preferable that a number of composite parts of the shaping members of the mold corresponds to a number of depressions/protrusions on the article being compacted of the powder material.

When compacting articles having an internal cavity or a developed surface, the shaping members of the mold preferably have a minimum difference between areas of the passive shaping surfaces belonging to oppositely directed shaping members of the mold.

The method for compacting powder materials into articles in accordance with the present invention solves the problems of the prior art methods owing to the fact that parts of the shaping surfaces, that form a common passive shaping surface, move in opposite directions in the process of compacting relative to the article being compacted. The oppositely directed wall friction forces appearing along this surface are cancelled. The present method uses a minimum number of the shaping members of the mold required for unforced removal of the article from the mold. In this case no destructive effect of friction against the shaping surfaces occurs. The shaping members of the mold have no closed hard-to-reach shaping surfaces. Dimension of a minimum section, normal to the compacting direction, of the shaping members of the mold that experience mechanical force may be selected independently of their hydraulic area.

In the resulting articles, the value of density differential $\Delta\rho$ along the compacting height h is determined by the expression:

$$\Delta\rho = b \cdot \xi \cdot \frac{(S' \cdot f' - S'' \cdot f'')}{S_0} \tag{13}$$

where b is the compacting factor (a constant value defining the compaction ratio of the powder compacted);

$\xi$ is the lateral pressure factor;

S' is the part of the passive shaping surface belonging to one shaping member of the mold;

f' is the factor of friction of the compacted powder against the part of the passive shaping surface having area S', belonging to one shaping member of the mold;

S" is the part of the shaping surface belonging to the other shaping member of the mold;

f" is the factor of friction of the compacted powder against the part of the passive shaping surface having area S", belonging to the other shaping member of the mold;

$S_0$ is the compacting hydraulic area (projection of the active shaping surface onto the surface normal to the pressing axis).

As follows from expression (13), in addition to the lateral pressure factor and geometrical parameters of the article, distribution of the average density in the section normal to pressing axis along the height depends on the relationship of values of the friction forces acting on oppositely directed parts of the passive shaping surface split along the pressing axis, that form a common closed surface parallel to the pressing axis. There is no density differential along the compacting height if the areas of oppositely moving parts of the common closed passive shaping surface are equal (S'=S") and conditions of wall friction on the parts are the same (f'=f"). The total condition for obtaining even density of the article manufactured by the present method is:

$$S' \cdot f' = S'' \cdot f'' \tag{14}$$

A method for forming articles in a shape of circle or its segment in one projection permits the formation of defect-free articles of irregular configuration with a minimum density differential along the pressing axis other than a straight line.

If the conditions of equal areas of oppositely directed parts of the passive shaping surface cannot be met, when condition (S'/S") is other than unity, to attain a maximum of the basic technical result it is necessary to change proportionally the value of relation (f'/f") by process measures or external effect so that the respective products of areas and wall friction factors were equal. When forming an article with a through-hole whose axis coincides with the pressing axis, the movement direction of the insertion member forming the hole should be selected so that to meet the condition of minimum difference between the dimensions of counter moving parts of the passive shaping surface.

The technical result can be attained by both the reduction in the wall friction factor acting on a larger portion of the passive shaping surface, and by increase in the wall friction factor acting on a smaller portion of the surface. The increase in the wall friction factor, leading to raised compaction pressure loss, is economically unreasonable. Therefore, the condition of even density of the article must be provided by reducing the wall friction factor acting on the larger portion of the passive shaping surface.

Based on relation (13), wall friction parameters must be selectively varied. It means that when reducing the wall friction factor acting on the larger portion of the surface, one must avoid the respective reduction in the wall friction factor acting on the smaller portion.

Active and operational control of the wall friction parameters in the process of compacting powder materials can be implemented by applying mechanical oscillation. In such a case the wall friction force does not act at the oscillating wall of the mold constantly, but only when the rubbing surfaces contact. The oscillation can selectively act on the wall friction parameters when the oscillation is applied to the mold component bearing the larger portion of the passive shaping surface. As in the course of compacting the counter moving members of the mold are acoustically connected with one another only through the powder body, the undesirable reduction in the friction factor acting on the smaller portion of the passive shaping surface will be less. The greater the oscillation frequency, the higher is the attenuation of oscillations in the powder body. The use of low-frequency oscillation for this purpose may happen to be of little efficiency. Therefore, to provide selective reduction in the wall friction force in the process of compacting powder materials it is advantageous to apply oscillations of supersonic frequency range.

The presence of the active shaping surface and a part of the passive shaping surface on each of the shaping members of the mold provides the condition of creating oppositely directed wall friction forces and appearance of the compaction pressure of constant value that is transferred to all layers of the powder article and provides the same ratio of their compaction.

The shaping members of the present mold have the section receiving the pressing force that substantially exceeds the dimension of the hydraulic section of the compacted article, this allowing the compaction pressure to be considerably increased beyond the limits of the maximum permissible mechanical stress value for the material of mold members. This extends the range of the compaction pressure and alleviates requirements to the material quality of the molds for compacting powder materials.

BRIEF DESCRIPTION OF THE DRAWINGS

The invention will become more apparent from the following detailed description of its embodiments taken in conjunction with the attached drawings in which:

FIGS. 7(*a, b*) is a general view of a mold for compacting an article in the shape of a ring segment with rectangular section along a curved axis, and a ring segment with rectangular section, in accordance with the invention;

FIGS. 8(*a, b*) is a general view of a mold for compacting a plurality of articles in the shape of a ring segment with rectangular section along a curved axis, and ring segments with rectangular section, in accordance with the invention;

DETAILED DESCRIPTION OF PREFERRED EMBODIMENTS

Figure 1A:
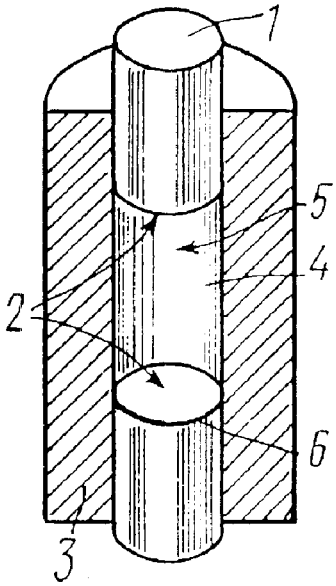
FIGS. 1(*a*), (*b, c*) shows mold (*a*) for uniaxial single-action compacting of powder materials into a cylinder article molds (*b, c*)—in accordance with the invention.
Figure 1B:
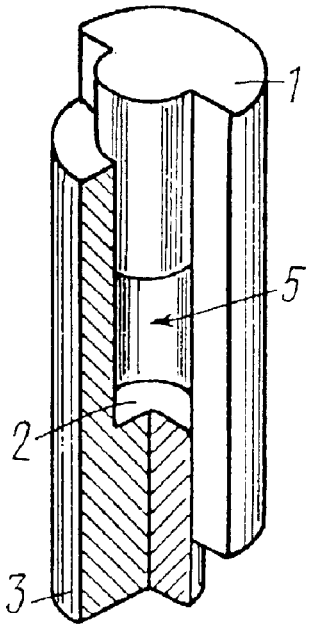
Figure 1C:
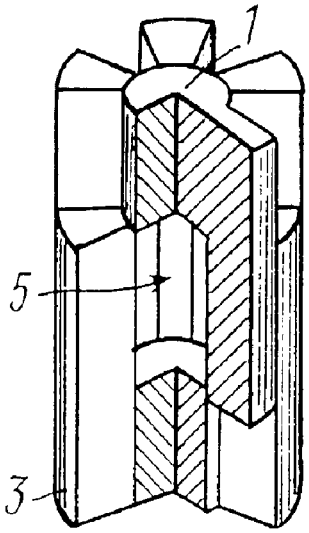
Figure 2A:
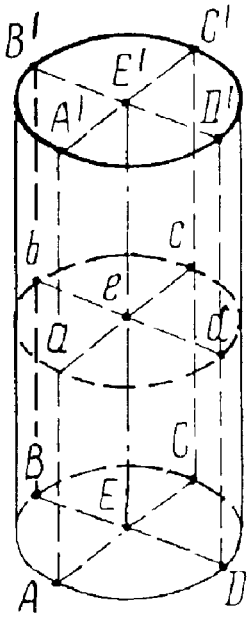
FIGS. 2(*a, b, c*) shows a schematic diagram of compacting a powder material into articles.
Figure 2B:
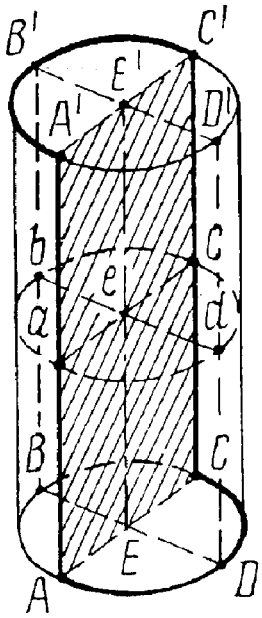
Figure 2C:
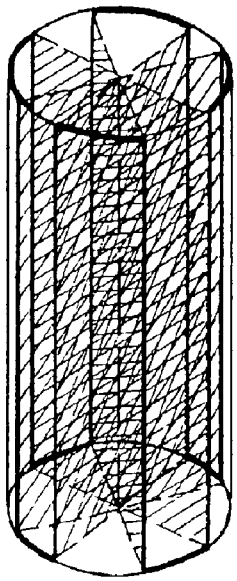
Figure 3:
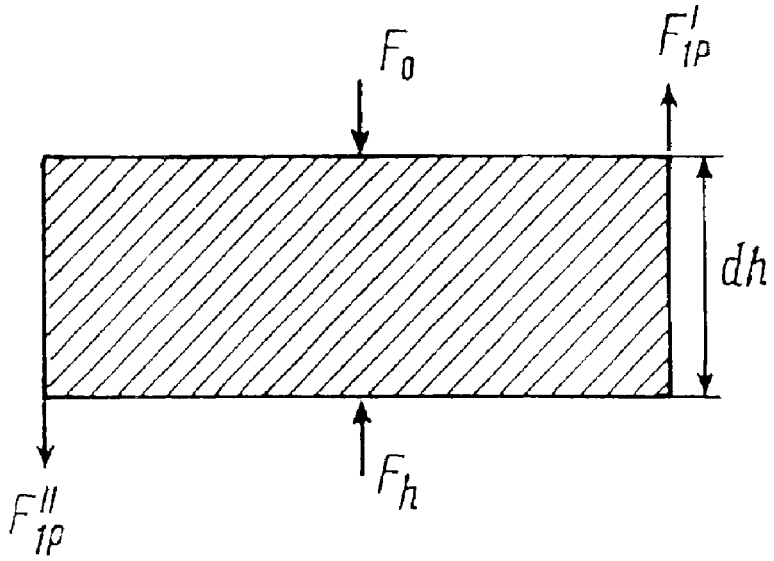
FIG. 3 shows a distribution of forces acting in a small layer of the article compacted of a powder material in accordance with the invention.
Figure 4:
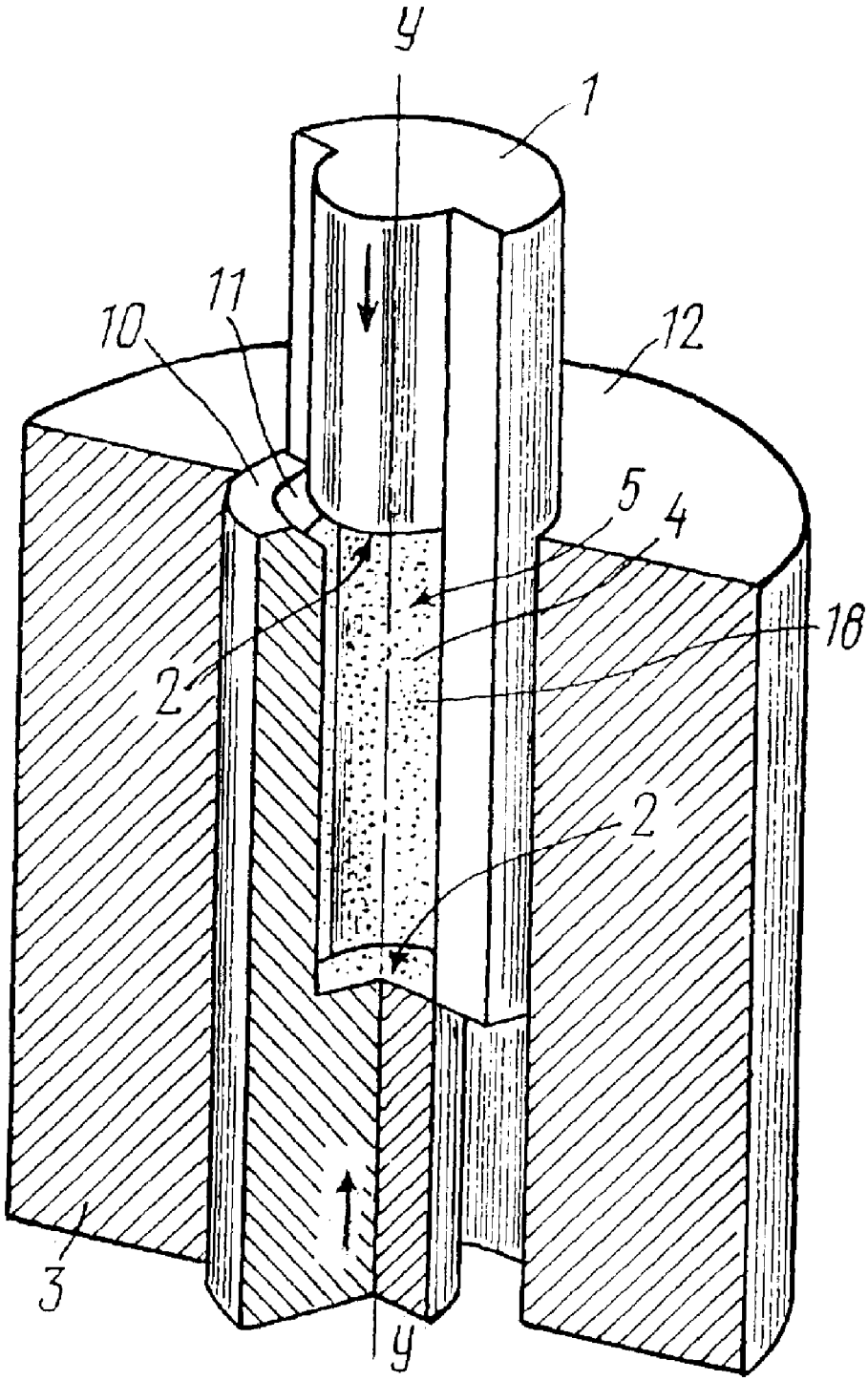
FIG. 4 is a general view of a mold for compacting articles of powder materials, comprising a pair of shaping members having active and passive shaping surfaces, respectively, in accordance with the invention.

An embodiment of a mold (FIG. 4) for compacting powder materials into articles in accordance with the invention comprises a pair of one-piece shaping members 1, 3 having active and passive shaping surfaces 2, 4, respectively. The shaping surfaces 2, 4 define a shaping cavity 5. The shaping members 1, 2 are arranged so as to mutually move along pressing axis y—y. Pressing force is transferred from the shaping members 1, 3 to the powder material through the active shaping surfaces 2, while the passive shaping surfaces 4 serve to form surfaces of the powder article, parallel to the pressing axis.

Section planes of the mold members are shown by hatching. For illustration, some components of the shaping members are omitted, or shown offset along the pressing axis to a position for filling the powder, or shown by thin lines as if made of a transparent material.

In accordance with the invention, the one-piece or composite shaping members 1, 3 of the mold, split along pressing axis y—y, comprise a part of at least one continuous passive shaping surface 4 split along the pressing axis.

In this case, on each of the shaping members 1, 3 there is located at least one part of at least one continuous passive shaping surface 4 split along pressing axis and intended for forming surfaces of the powder article, parallel to the pressing axis, and a part of at least one active shaping surface 2 intended for transferring the pressing force.

To facilitate filling of the powder, removal of the entrapped air or liquid through mating gaps, and to make the mold manufacture, assembly and maintenance easier, the shaping members 1, 3 are made composite (FIG. 5) and include a plurality of components 7, 8, respectively.

Figure 6:
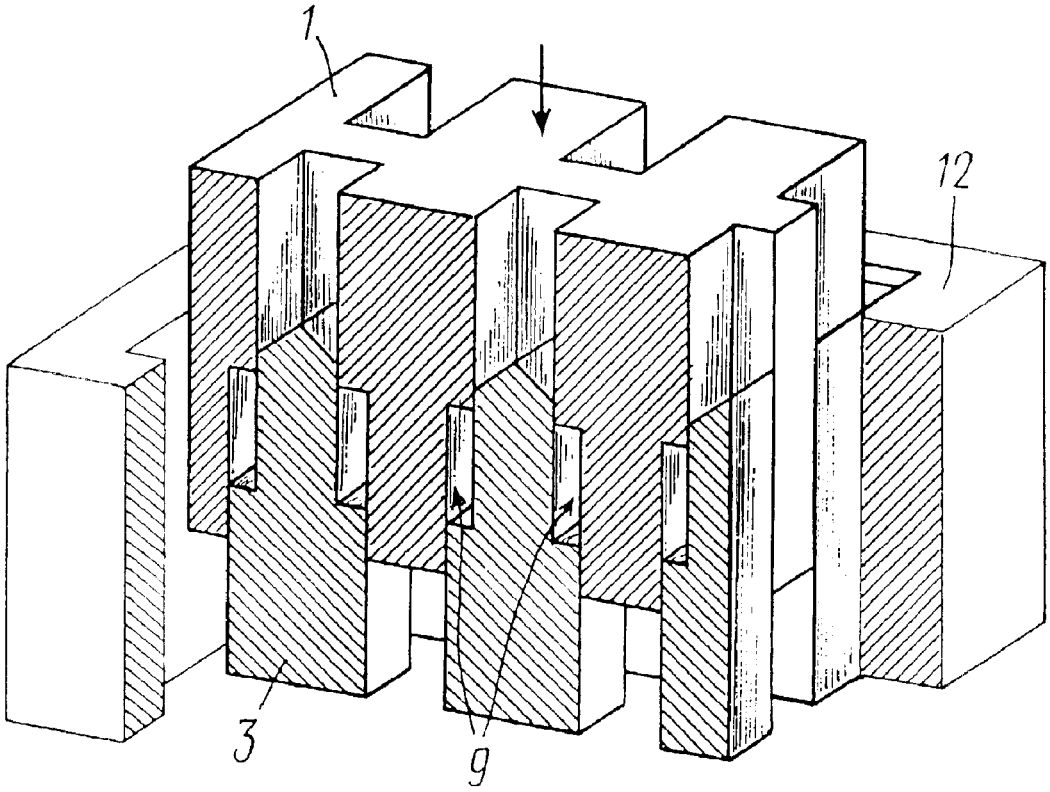
FIG. 6 is a general view of a mold for batch production of single-type articles of powder materials in the rectangular bar shape, in accordance with the invention.

In an embodiment of a mold (FIG. 6), each of the one-piece or composite shaping members 1, 3 comprises parts of passive and parts of active shaping surfaces 2, 4 that define a plurality of cavities 9 for compacting a plurality of powder articles.

The plurality of powder articles may be of the same or different shape (not shown).

An end face 10 (FIG. 4) of at least one of the one-piece or composite shaping members 1, 3 comprises at least one groove 11 for filling the powder material in the shaping cavity 5 of the mold.

The shaping members 1, 3 are capable of mutually moving in opposite directions along pressing axis y—y. The movement direction is shown by arrows.

Figures 9A, 9B:
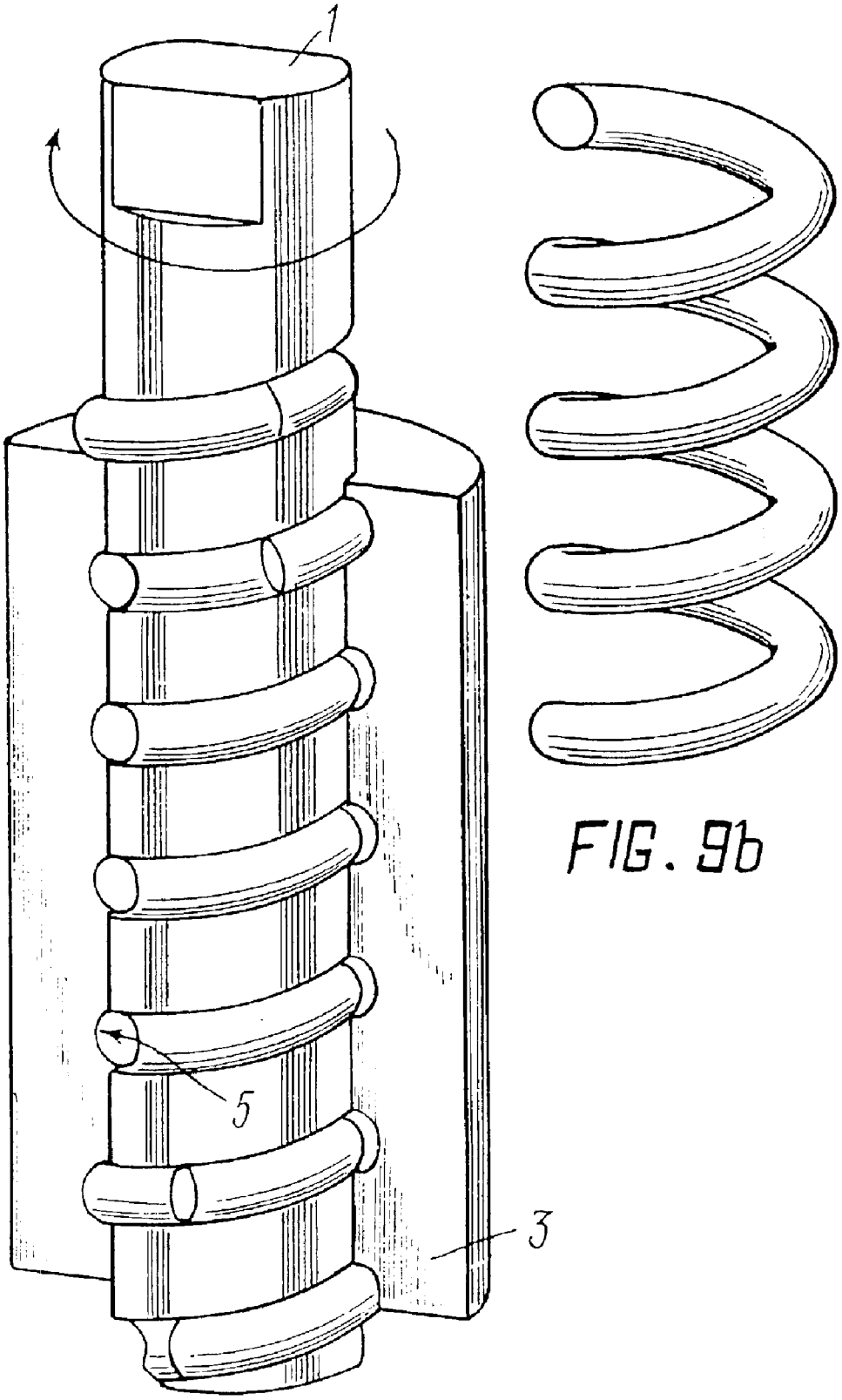
FIGS. 9(*a, b*) is a general view of a mold for compacting a helix-shaped article, in accordance with the invention.

The pressing axis y—y is selected from the group consisting of a straight pressing axis (FIGS. 4, 5, 6), a curved pressing axis (not shown), a circular arc (FIGS. 7, 8) and an element of a helical curve (FIG. 9) with a permanent or variable pitch.

The mold further comprises means 12 (FIG. 4) to prevent an off-axis displacement of the one-piece or composite shaping members 1, 3.

Figure 10:
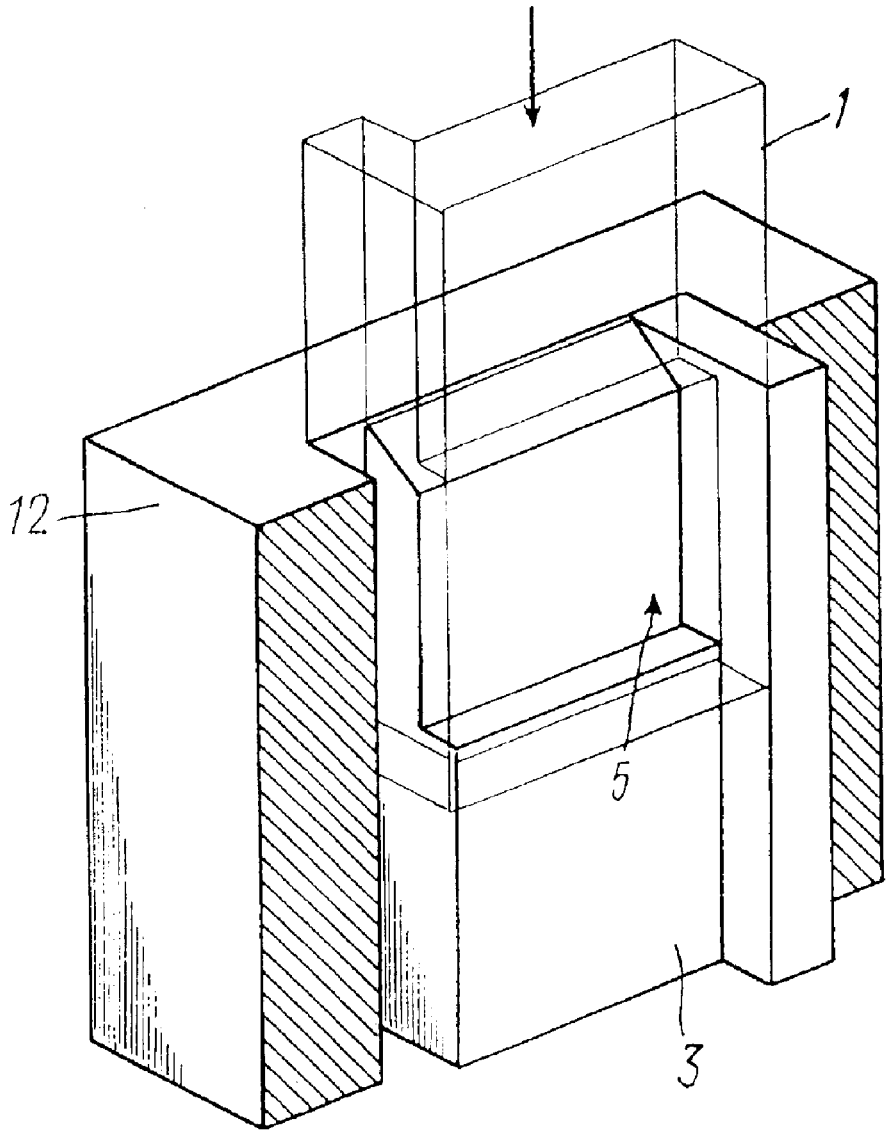
FIG. 10 is a general view of a mold for uniaxial compacting of an article in the rectangular bar shape, in accordance with the invention.
Figure 15:
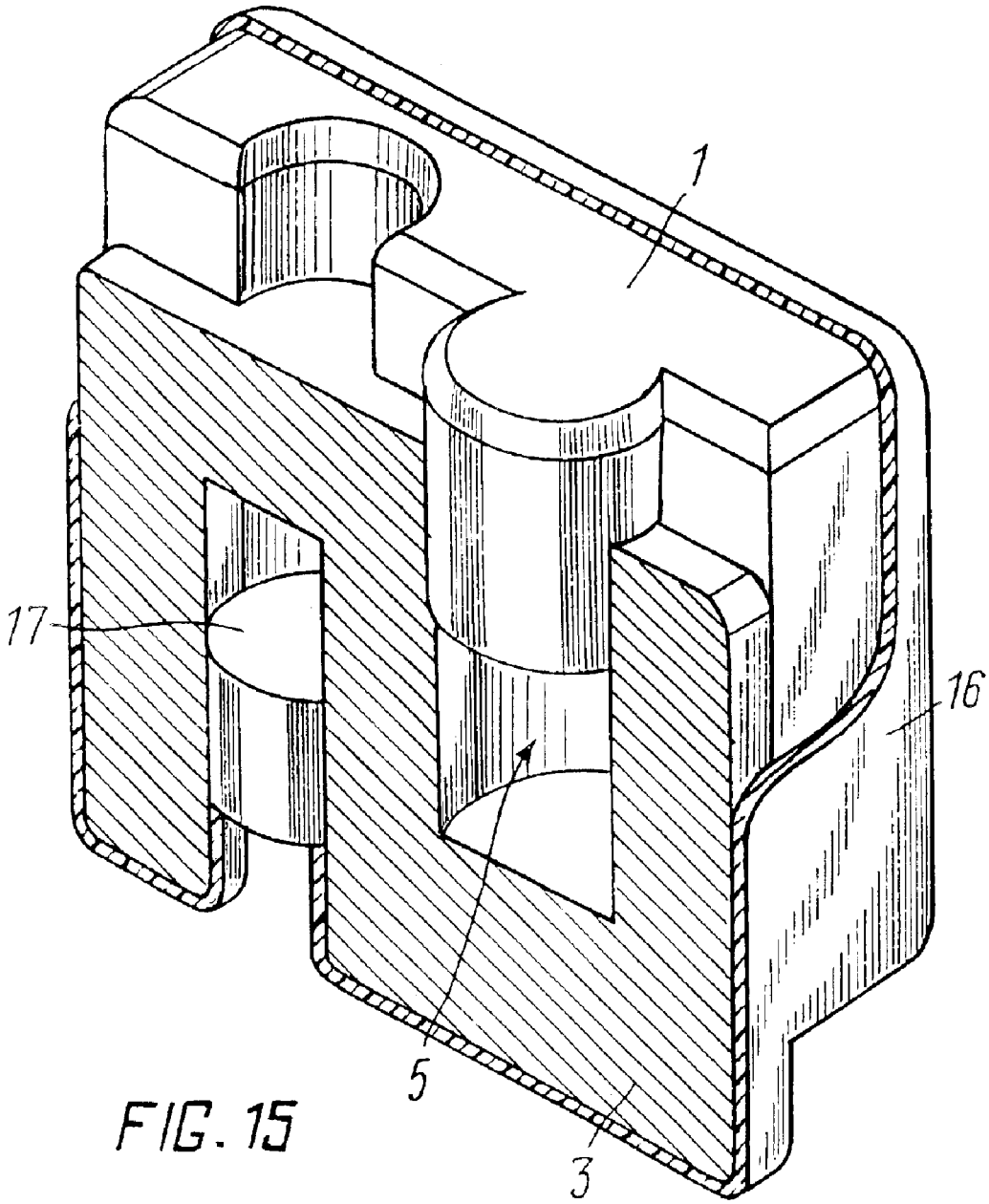
FIG. 15 is a general view of mold having an elastic enclosure for compacting in gas/hydrostats and an additional cavity for collecting air forced out by compacting, in accordance with the invention.

The means 12 for preventing an off-axis displacement of the one-piece or composite shaping members 1, 3 can be a structural element selected from the group consisting of a shroud (FIG. 10), a fixture (FIGS. 4, 5), a pivot of the common axis of mutual movement of the shaping members (FIGS. 7, 8), a spline engagement (FIGS. 6, 9) of the one-piece or composite members with one another, a bayonet engagement (FIG. 6) of the one-piece or composite shaping members, an elastic enclosure (FIG. 15).

The means 12 for preventing an off-axis displacement of the one-piece or composite shaping members may be at least one of the one-piece or composite shaping members 1, 3 (FIG. 7).

Figure 11A:
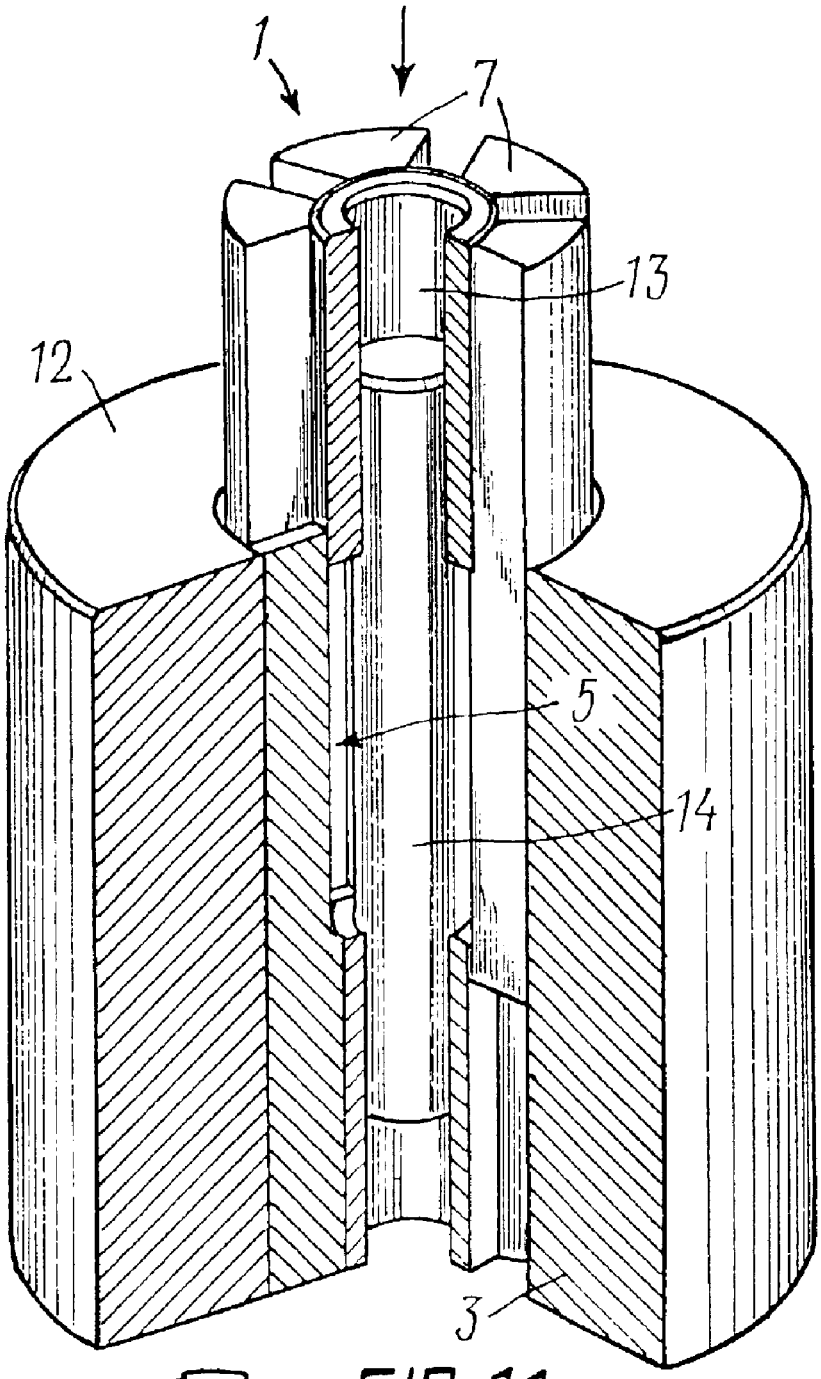
FIGS. 11(*a, b*) is a general view of a mold for compacting an article in the shape of a pinion for cylindrical gearing, and a pinion for cylindrical gearing, in accordance with the invention.
Figure 11B:
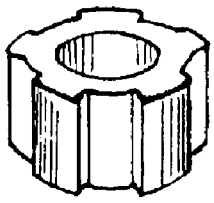
Figure 12B:
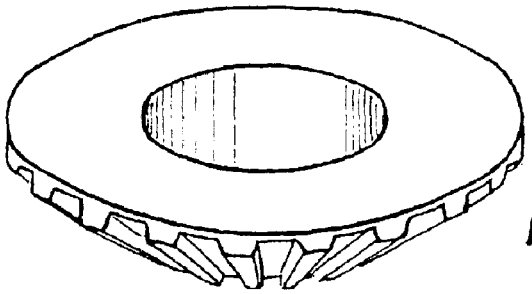
FIGS. 12(*a, b*) is a general view of a mold for compacting an article in the shape of a pinion for bevel gearing, and a pinion for bevel gearing, in accordance with the invention.
Figure 12A:
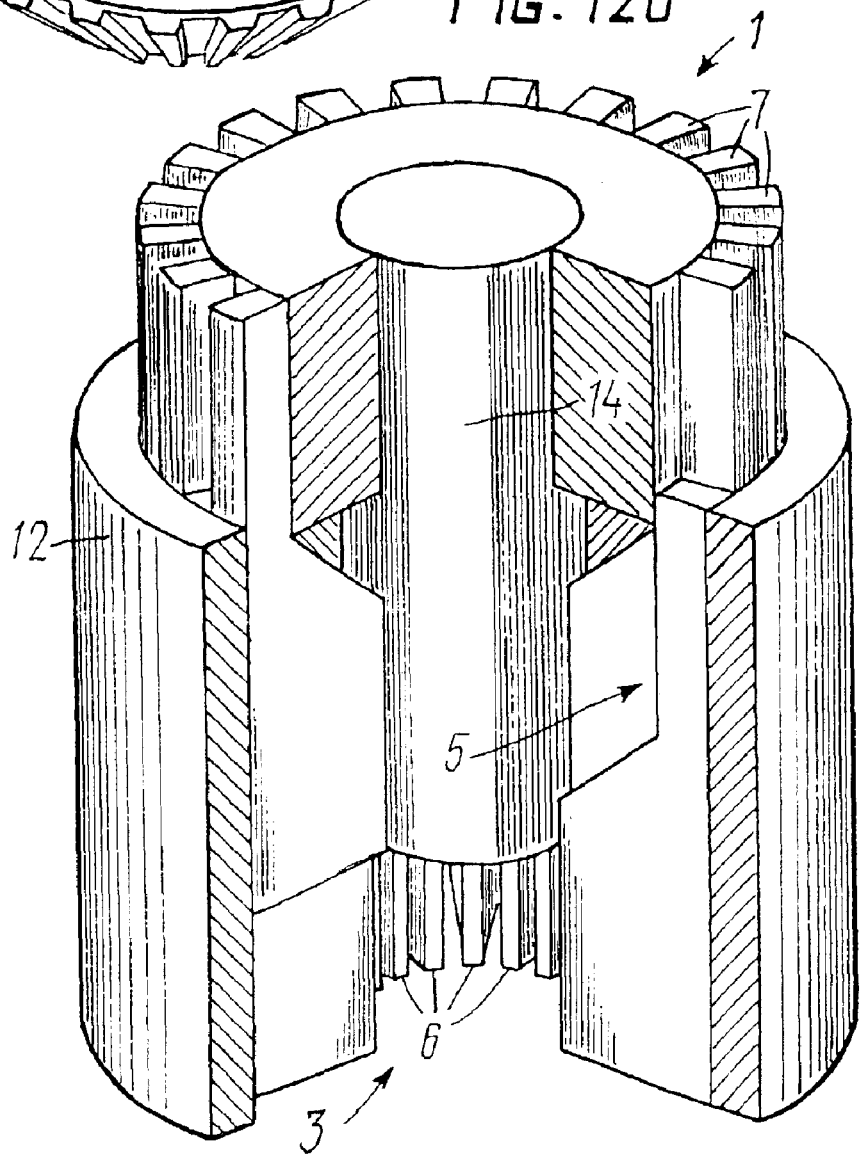

For compacting articles having a through-hole 13 (FIG. 11) whose axis coincides with the pressing axis y—y, an insertion member 14 is used. The movement direction of the insertion member 14 forming the through-hole is selected so that to satisfy the condition of minimum difference between dimensions of areas of the counter moving parts of the passive shaping surface.

Figure 5:
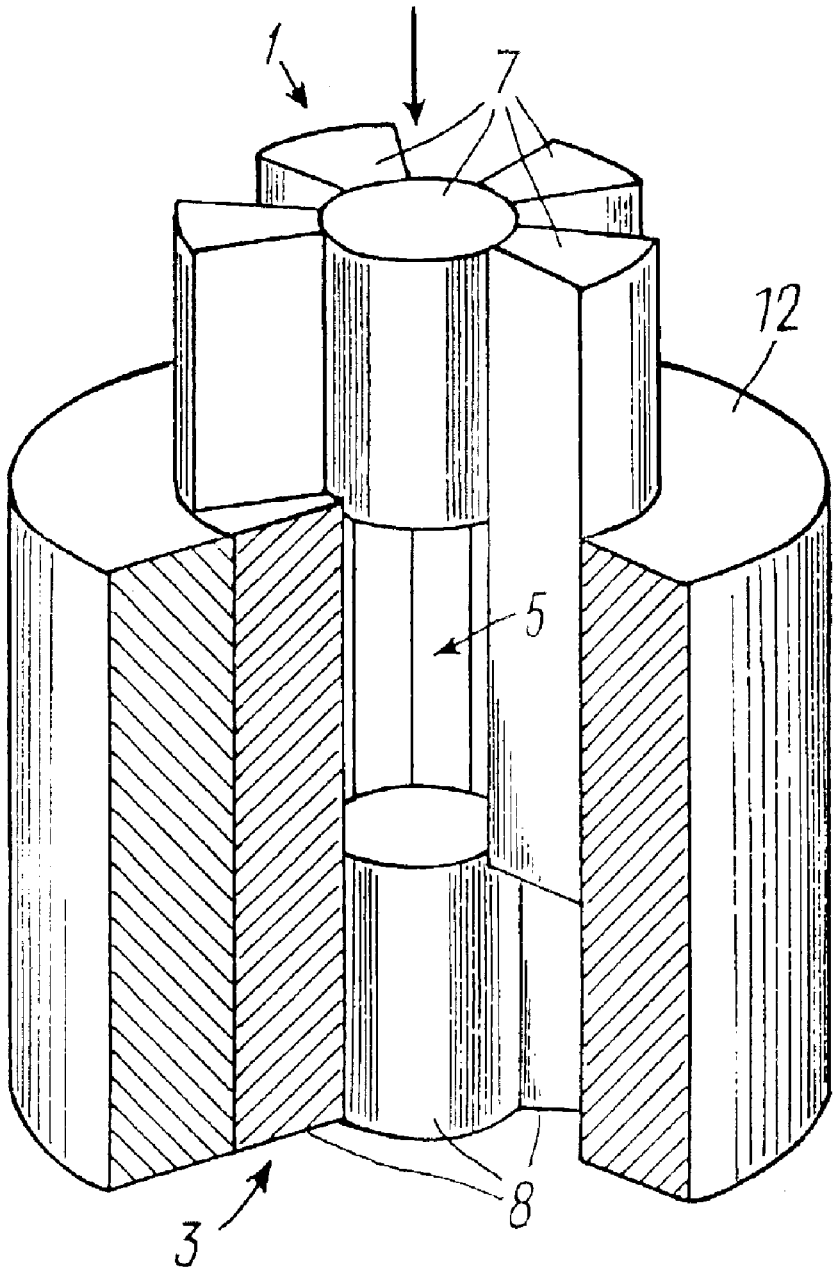
FIG. 5 is a general view of a mold having ten alternating parts of a passive shaping surface, in accordance with the invention.

In compacting articles such as a cylindrical pinion, a cutter or an impeller ((FIG. 11)), the number of components 7, 8 (FIG. 5) of the shaping members 1, 3 of the mold corresponds to the number of depressions/protrusions of the article being compacted of a powder material. To provide even density of the compacted articles throughout the volume, the shear plastic deformation ratio of the powder material is further increased by increasing the number of the components of shaping members of the mold (FIG. 5).

Figure 13:
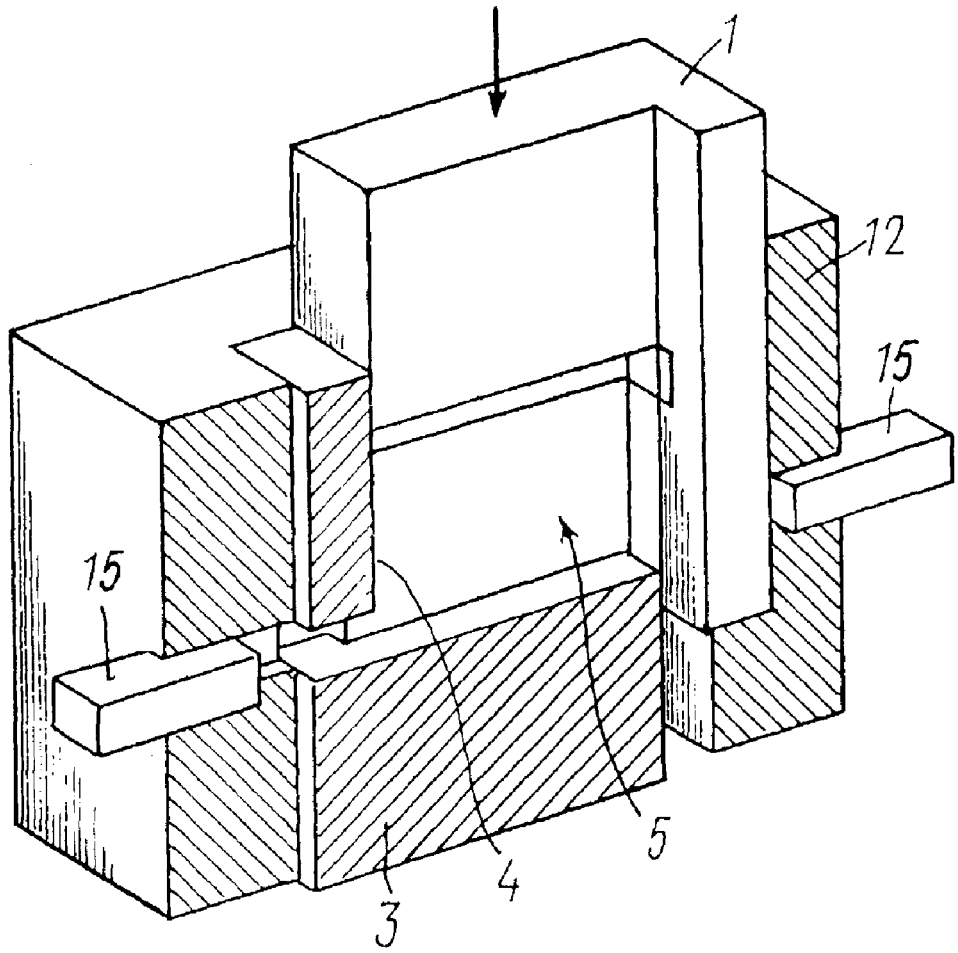
FIG. 13 is a general view of a mold for biaxial compacting of an article in the rectangular bar shape, in accordance with the invention.

The present method can be also implemented with a biaxial compacting route (FIG. 13) using supplementary insertion members 15 (only one insertion member shown) disposed in the shaping members 1, 3. The compacting can be performed separately, i.e. by pressing along one axis by counter movement of the shaping members 1, 3, or by simultaneously compacting the powder material in two non-parallel directions.

Figure 14A:
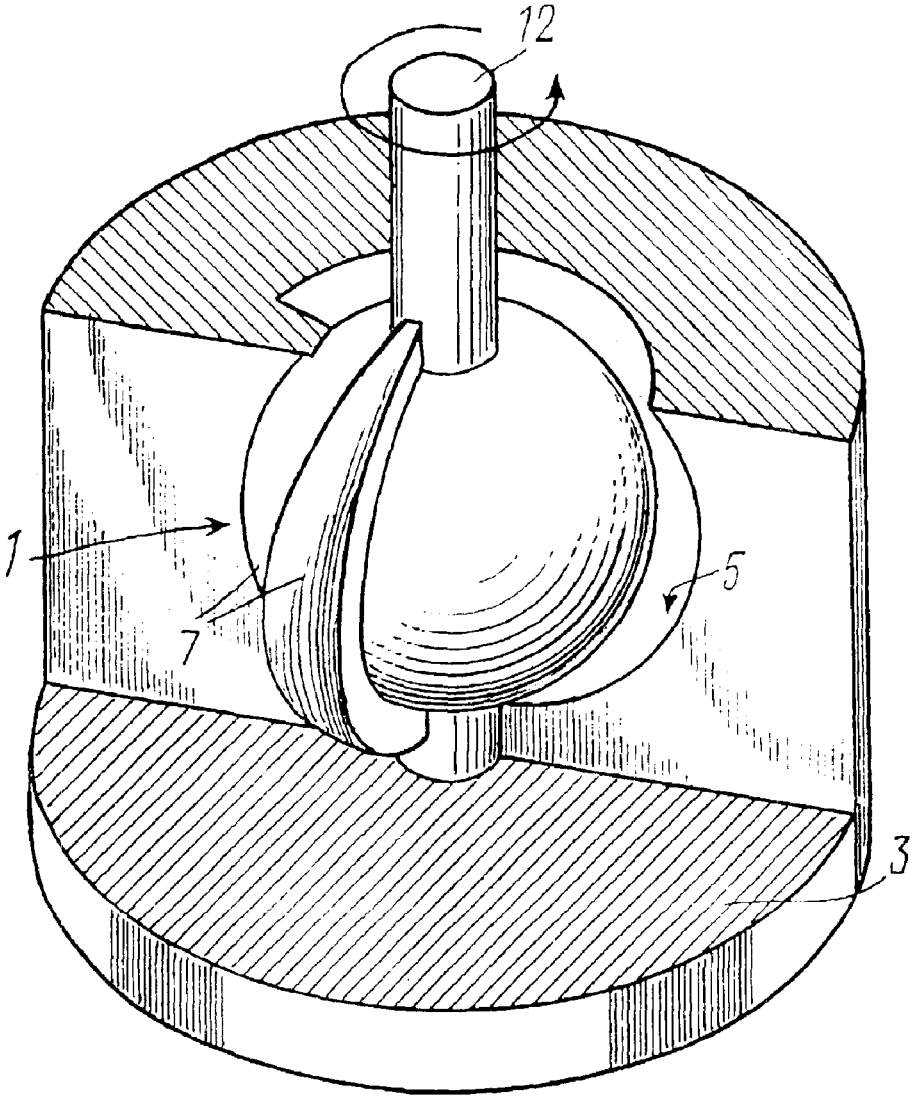
FIG. 14 is a general view of a mold for compacting an article in the shape of a sphere segment, and a sphere segment, in accordance with the invention.
Figure 14B:
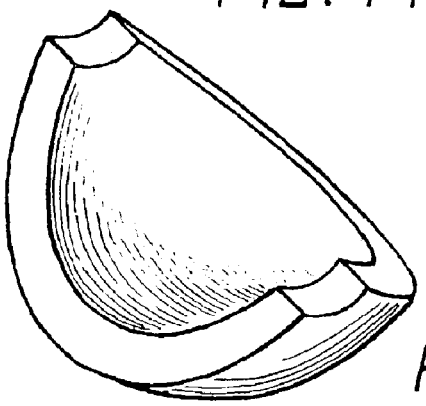

To form articles in the shape of a segment of hollow rotation body (FIG. 14), compacting is performed along a circular arc by rotating the shaping member 3 in a composite shaping member 1 which at the same time retains the member 3 against an off-axis displacement.

FIG. 15 shows a mold having an elastic enclosure 16 for compacting articles of powder materials in gas/hydrostats, and a supplementary cavity 17 to collect air forced out from the powder material by pressing.

Retention of the shaping members 1, 3 by external pressing force may be implemented by placing the shaping members 1, 3 filled with powder and protected by the elastic enclosure 16. Compaction occurs at smooth or pulsed pressure increase in the gas/hydrostat environment because the reduction of the total volume of the shaping members with powder material enclosed in the enclosure is possible only when they perform axial counter movement. As the pressure releases under the elastic aftereffect force, the article will be loosened on all sides at the same time.

To collect air forced out by compacting the powder material, the shaping members may have, as indicated above, supplemental cavities 17 (FIG. 15). To provide active collection of the air, volume of the supplemental cavity may increase in the compacting process.

A method for compacting powder materials into articles is implemented in the following fashion.

A powder material 18 (FIG. 4) is placed in a shaping cavity 5 of a mold, defined by active and passive shaping surfaces 2, 4 of one-piece or composite shaping members 1, 3, respectively, of the mold.

The shaping members 1, 3 of the mold are mutually moved along pressing axis y—y, with the pressing force transferred from the shaping members 1, 3 of the mold to the powder material 18 through the active shaping surfaces 2.

Surfaces of the article of the powder material, parallel to the pressing axis, are formed by the passive shaping surfaces 2 of the one-piece or composite shaping members 1, 3 of the mold.

In the method in accordance with the invention, for forming surfaces of the powder article, parallel to the pressing axis, there are used parts of at least one passive shaping surface, located on the one-piece or composite shaping members 1, 3 split along the pressing axis.

The shaping members of the mold are moved so that at least one continuous surface of the powder article, parallel to the pressing axis, is formed by the aforementioned parts of at least one passive shaping surface split along the pressing axis, that belong to different shaping members. The different shaping members are moved in opposite directions (shown by arrows).

Compacting is accomplished by counter movement of the one-piece or composite shaping members along a straight pressing axis or a curved pressing axis.

The curved pressing axis may be a circular arc or an element of a helical curve with a permanent or variable pitch.

In the course of compacting powder materials into articles, mechanical oscillation is preferably applied to the one-piece or composite shaping members. The mechanical oscillation is of ultrasonic frequency range.

In some cases, the mechanical oscillation is applied to the one-piece or composite shaping members of the mold comprising a larger portion of the passive shaping surface.

In manufacture of long-length articles, variation of the wall friction factor along the height leads to the necessity to use ultrasonic oscillation directed in parallel to the passive shaping surface. The direction generally coincides with the direction of the pressing axis. In this case distribution of oscillation amplitude of the shaping members along the pressing axis will descend with reduction in the wall friction factor value. The manner of variation of the oscillation amplitude along the passive shaping surface may be chosen so that to bring the wavelength in conformity with the resonant length of the waveguide, the shaping member, by varying the oscillation frequency.

For equiaxial and small-size articles in which variation of the wall friction factor along the pressing axis can be neglected, it is expedient to use ultrasonic oscillation directed perpendicular to the passive shaping surface. In this case the ultrasonic accessories will not interfere with compacting the material as they are arranged along the axis perpendicular to the pressing axis.

When compacting articles having a through-hole whose axis coincides with the pressing axis, the movement direction of the insertion member forming the hole is selected so that to satisfy the condition of minimum difference between dimensions of areas of counter moving parts of the passive shaping surface.

Compacting in accordance with the present method can be classified neither single-action, nor double-action compacting because the points of powder zero displacement relative to different parts of the passive shaping surface are located at different heights, and are not defined along vertical line of their mobile conjugation.

The end of the compacting process can be controlled "by pressure" and "up to the stop". In different embodiments of the method, the powder can be dosed by weight and by volume.

To compact articles of irregular shape or with a developed surface it is not always possible to structurally split the common passive shaping surface of the mold into counter moving parts having equal areas. In this case, to obtain articles with even density in accordance with equation (13) the value of wall friction factor acting of the larger surface is reduced in proportion to the relation of these areas to satisfy condition (14).

The wall friction factor can be reduced with the aid of a process lubricant applied to a respective surface, or by applying ultrasonic mechanical oscillation to one of the shaping members of the mold. The ultrasonic oscillation must be applied with account of the following peculiarities.

In the compacting process it is required to reduce the friction factor acting on the surface having a larger area. Thus, the oscillation should be applied to the shaping member bearing the larger portion of the passive shaping surface.

As in the compacting process the shaping members are acoustically coupled with one another only through the powder material which absorbs high-frequency mechanical oscillation in a non-linear manner, then a required relation of values of wall friction factors acting on different parts of the passive shaping surface, having different areas, can be achieved by varying the amount of ultrasonic effect.

EXAMPLE

Using a method for compacting in accordance with the invention without lubricants, fluidizing agents and ultrasonic oscillation, articles of the seventh complexity group were fabricated of a raw plasmachemical finely dispersed powder of technical ceramic with the composition $ZrO_2$-3 mole % $Y_2O_3$. None of the articles was defective.

The rated density differential along the height of the article fabricated by a prior art single-action static compacting was about 4%.

In the articles fabricated by the present method, the rated density differential was about 0.5% which correlates well with the differential value of 0.7–0.3% calculated from expression (13) depending on a floating or counter movement route of the insertion member. The nonzero density differential is explained by the fact that the condition of equality of parts of the passive shaping surface cannot be met in full measure.

INDUSTRIAL APPLICABILITY

A method in accordance with the present invention allows pressing powder materials into defect-free articles by compacting the powder in a closed mold with application of external force through mutual counter movement of a pair of one-piece or composite shaping members of the mold, in each of the shaping members a part of a passive surface being combined with a part of an active surface of the mold so that they constitute a common closed shaping surface in the process of forming.

A mold in accordance with the present invention ensures the attainment of equal product of the areas of counter moving parts of the common passive shaping surface and respective wall friction factors, this providing an even distribution of the average density of the powder body in a section perpendicular to the pressing axis density along the axis.

The method can be also implemented in the cases when the passive shaping surface partly acts as the active shaping surface. This occurs in compacting articles having a section smoothly varying along the height, e.g. articles of conical, spherical, pyramid shape where the passive shaping surface is disposed at some nonzero angle to the pressing axis.

Compacting in accordance with the present method can be implemented using uniaxial and multiaxial pattern. By the type of load application, compacting of the material may be static and dynamic.

The present method is not tied to any particular type of pressing equipment in practical use. Embodiments of the method can be implemented using any types of presses: multi-purpose and specialized hydraulic presses, single- and multipass presses, gas/hydrostats.

The compacting pattern in accordance with the invention simplifies fabrication and operation of multiform molds because it allows the use of a single part, simple in fabrication, for compacting several articles at once by integrating single-type shaping members of different molds in a single shaping member bearing shaping surfaces for forming a plurality of single-type articles of regular shape.

In addition to articles having a regular geometrical shape, the method in accordance with the invention makes it possible to fabricate articles of any complexity group and to compact a material along a curved axis (circular arc, helical curve with a permanent pitch).

What is claimed is:

1. A method for compacting powder materials into articles, comprising the steps of: placing a powder material in a shaping cavity of a mold, said cavity being defined by active and passive shaping surfaces of one-piece or composite shaping members of the mold; mutually moving said shaping members of said mold along a pressing axis, with the pressing force transferred from said shaping members of said mold to said powder material through the active shaping surfaces; and forming surfaces of the powder article, parallel to the pressing axis, by the passive shaping surfaces of said one-piece or composite shaping members of the mold, wherein said forming of surfaces of the powder article, parallel to the pressing axis, comprises using parts of at least one said passive shaping surface, located on said one-piece or composite shaping members, split along the pressing axis; said shaping members of the mold are moved so that at least one continuous surface of said powder article, parallel to the pressing axis, is formed by said parts of at least one said passive shaping surface split along the pressing axis, the parts belonging to different said shaping members moving in opposite directions.

2. The method for compacting according to claim 1, wherein said compacting is accomplished by counter movement of said one-piece or composite shaping members along a straight pressing axis.

3. The method for compacting according to claim 1, wherein said compacting is accomplished by counter movement of said one-piece or composite shaping members along a curved pressing axis.

4. The method for compacting according to claim 3, wherein said curved pressing axis is a circular arc.

5. The method for compacting according to claim 3, wherein said curved pressing axis is an element of a helical curve with a permanent or variable pitch.

6. The method for compacting according to claim 1, wherein mechanical oscillations are applied to said one-piece or composite shaping members of the mold when compacting said articles of powder materials.

7. The method for compacting according to claim 6, wherein said mechanical oscillations are of ultrasonic frequency range.

8. The method for compacting according to claim 6, wherein said mechanical oscillations are applied to said one-piece or composite shaping members of the mold, comprising a larger portion of said passive shaping surface.

9. The method for compacting according to claim 1, wherein when compacting articles having an internal cavity or a developed surface, said shaping members have a minimum difference between areas of said passive shaping surfaces belonging to oppositely directed shaping members of the mold.

10. A mold for compacting powder materials into articles, comprising: a pair of one-piece or composite shaping members for forming a shaping cavity defined by active and passive shaping surfaces, said shaping members being arranged so that to mutually move along a pressing axis, with the pressing force transferred from said shaping members to the powder material through said active shaping surfaces, while said passive shaping surfaces serve to form surfaces of the powder article, parallel to the pressing axis, wherein said one-piece or composite shaping members of the mold, split along the pressing axis, comprise a part of at least one said continuous passive shaping surface split along the pressing axis; on each of said shaping members located is at least one part of at least one said continuous passive shaping surface split along the pressing axis and intended for forming said surfaces of the powder article, parallel to the pressing axis, and a part of at least one said active shaping surface intended for transferring the pressing force.

11. The mold according to claim 10, wherein each of said one-piece or composite shaping members of the mold comprises parts of said passive shaping surfaces and parts of said active shaping surfaces to define a plurality of cavities for compacting said plurality of powder articles.

12. The mold according to claim 11, wherein said plurality of powder articles have the same shape.

13. The mold according to claim 11, wherein said plurality of powder articles have different shape.

14. The mold according to claim 11, wherein an end face of at least one of said one-piece or composite shaping members has at least one groove for filling said powder material into at least one said shaping cavity of said mold.

15. The mold according to claim 11, wherein said shaping members are capable of mutually moving in opposite directions along said pressing axis.

16. The mold according to claim 15, wherein said pressing axis is selected from the group consisting of a straight pressing axis, a curved pressing axis and a circular arc and an element of a helical curve with a permanent or variable pitch.

17. The mold according to claim 10, further comprising means for preventing an off-axis displacement of said one-piece or composite shaping members.

18. The mold according to claim 17, wherein said means for preventing an off-axis displacement of said one-piece of composite members is a structural element selected from the group consisting of a shroud, a fixture, a pivot of the common axis of mutual movement of the shaping members, a spline engagement of the one-piece or composite members with one another, a bayonet engagement of the one-piece or composite shaping members, an elastic enclosure.

19. The mold according to claim 17, wherein said means for preventing an off-axis displacement of the one-piece of composite members is at least one of said one-piece or composite shaping members.

20. The mold according to claim 10, wherein said one-piece or composite shaping members have at least one groove to form a supplemental cavity for collecting gas or liquid forced out when said powder material is compacted.

21. The mold according to claim 20, wherein said supplemental cavity is capable of increasing its volume at mutual movement of said one-piece or composite shaping members of the mold.

22. The mold according to claim 10, wherein a number of components of said shaping members of the mold correspond to a number of depressions/protrusions on the article being compacted of said powder material.

23. The mold according to claim 10, wherein when compacting articles having an internal cavity or a developed surface, said shaping members of the mold have a minimum difference between areas of said passive shaping surfaces belonging to oppositely directed said shaping members of the mold.

* * * * *